United States Patent [19]

Celette

[11] Patent Number: 4,791,802

[45] Date of Patent: Dec. 20, 1988

[54] INSTALLATION FOR THE REPAIR AND CHECKING OF VEHICLE BODIES

[76] Inventor: Germain Celette, 67, rue Maugiron, Vienne, Isere, France

[21] Appl. No.: 63,169

[22] Filed: Jun. 17, 1987

[30] Foreign Application Priority Data

Jun. 17, 1986 [FR] France ..... 86 09143

[51] Int. Cl.[4] ..... B21D 1/12

[52] U.S. Cl. ..... 72/447; 72/705

[58] Field of Search ..... 72/305, 705, 447

[56] References Cited

U.S. PATENT DOCUMENTS 4,055,061 10/1977 Bayorgeon et al. ..... 72/705

4,313,335 2/1982 Eck ..... 72/705

FOREIGN PATENT DOCUMENTS 2145992 3/1973 Fed. Rep. of Germany ..... 72/705

*Primary Examiner*—Lowell A. Larson

*Attorney, Agent, or Firm*—Wall and Roehrig

[57] ABSTRACT

An installation for the repair and the checking of vehicle bodies includes a bench having a rectangular frame made of tubular elements, and a pulling tower the forward end of which is equipped with a coupling device for detachably securing the pulling tower to the bench, the rectangular frame having a flange extending inwardly of the frame along the inner bottom edge thereof, the pulling tower having a base portion adapted to be received beneath the frame and having a stirrup constructed and arranged to engage on the flange and a shoe member carried by an axially movable rod for movement into engagement with the external surface of the tubular element and cooperating with the stirrup and flange to lock the pulling tower to the bench.

14 Claims, 2 Drawing Sheets

INSTALLATION FOR THE REPAIR AND CHECKING OF VEHICLE BODIES

BACKGROUND OF THE INVENTION

The present invention relates to installations for the repair and the checking of vehicle bodies, which, for example, have been damaged in an accident, and more particularly, to such installations of the type including a free-standing bench and a pulling tower assembly.

In order to execute a repair, especially by straightening of the pieces of sheet metal of a vehicle, an apparatus including a pulling tower assembly is generally used in conjunction with a bench to which the vehicle is secured by way of suitable clamps or jigs. The pulling tower assembly comprises a base constituted by an elongated member, such as a tubular beam capable of being slid beneath the bench and being equipt with means for clamping onto the frame of the bench. The bench is constituted by a rectangular frame made of two U-shaped and I-shaped metallic side members assembled together by two cross-pieces between the two longitudinal side members. The bench includes clamps for anchoring the body of the vehicle to be repaired, and cross-members which mount assemblies for repairing the vehicle and measuring apparatus.

At one end of the base-forming beam of the pulling tower, there is mounted an arm which is articulated around a horizontal shaft which extends transverse relative to the beam. A chain has one end hooked onto the vehicle body and its other end attached to the arm, which is adapted to be moved around its shaft and exert a traction on the chain, under the action of a hydraulic jack.

The angle of inclination of the articulated arm is adjustable making it possible to achieve a lateral slanting of the arm required to exert a traction under the angle which is most suitable.

A first drawback of the traditional benches, which are secured to the floor of the work space, is their rigidity, which results in the bench conforming to the possible unevennesses of the ground, which can result in measurement errors when the ground on which the rests is not perfectly flat.

In addition, in use, the straightening pulling tower assembly required a very large area especially because of the length of the base-forming beam of the assembly. Taking into account the length of the beam, it is indeed necessary to have available a large space with respect to the bench in order to be able to disengage the pulling tower from the bench and to move it relative to the bench in order to secure it at another point along the bench.

It must further be noted that the length of the pulling tower is further increased to the extent that its base is constituted of two parts such as two elongated beams, disposed in end-to-end relation, and articulated one on the other around a vertical shaft.

French Pat. No. 2 511 272 discloses an apparatus for straightening the chassis and bodies of vehicles, which comprises a bench with a reinforcing nose turned inwardly near its upper edge. That apparatus has an associated pulling tower the fore part of which is in the shape of a forward open stirrup, formed by two horizontal plates intended to be positioned, respectively above and below the frame of the bench, the upper plate being fitted with a hook which engages the reinforcing nose of the frame. That apparatus, however, is not satisfactory because, under conditions when the pulling tower is used, the portion of the pulling tower that is remote from the bench tends to tip upward, a displacement which is unopposed by the elements of the bench. It is thus impossible to obtain a good rigidity of the bench and of the pulling tower.

SUMMARY OF THE INVENTION

It is an object of the present invention to remedy those drawbacks by providing a bench which possesses a great rigidity and with which is associated a pulling tower which can be affixed to the bench, adjusted relative to the latter, and moved around the bench without requiring a large work area.

To that end, the installation includes a bench which is of the type comprising a rectangular frame made of tubular elements, and a pulling tower the forward end of which is equipt with means for attachment to the bench, is characterized in that the rectangular frame of the bench is equipt on its inner surface and near the lower edge thereof, with a flange of smaller section, while the associated pulling tower comprises a base adapted for engagement beneath the frame, and which includes a rearwardly open stirrup, adapted for engagement with the flange on the bench. On its other side the pulling tower is provided with a shoe which is directed forwardly and axially movable and adapted to be locked in the desired position, and to engage and be supported by the outer surface of one of the tubular side members which constitute the frame of the bench.

This arrangement prove advantageous in the sense that the use of tubular elements for the bench results an excellent rigidity, preventing any deformation of the latter, uneven when the ground on which the bench sits is uneven.

The rigidity of the bench is reinforced by the provision of the flange, which also serves for attachment of the pulling tower to the bench.

In use, to detachably secure the pulling tower to the bench, with the shoe retracted, the forward end of the pulling tower is positioned under the bench with the stirrup extending beyond the flange, moved backwards in order for the stirrup to be moved and hook itself over the flange located inside the frame.

Then the shoe is extended with the forward displacement of the shoe causing its placement into support against and engagement with the external wall of one of the tubular elements constituting the bench, and to lock the pulling tower to the bench in that position.

It can be seen from the above that attachement of the pulling tower to the bench is very simple. Moreover, the pulling tower has a reduced size relative to known pulling towers because its base portion does not require attachment to two of the elements of the frame, but only to one of them.

In addition, this structure makes possible, during the use, self-locking of the pulling tower on the bench. Indeed, if during the functioning of the pulling tower, the posterior end of same tends to tip upward, such displacement causes the stirrup, mounted at the fore end of the frame, to hook itself onto the flange on the lower inner surface of the bench frame such that the connecting end of the pulling tower is trapped within the frame, thus preventing all play between the pulling tower and the frame.

According to a feature of the invention, the return portion of the stirrup which hooks the pulling tower on the bench has a width less than that of the flange piece against which the stirrup is supported.

That arrangement proves advantageous because the stirrup simply covers the flange of the bench, without taking its support against the main side walls of the frame element of the bench, which prevents damaging of the bench.

According to another feature of the invention, the means for locking the support shoe against the external wall of one of the side elements of the bench, comprises a cotter pin engaged in a transverse opening made in a guiding sleeve for the shoe displacement rod, and supported against the posterior end of the rod.

During the operation for setting the pulling tower into place, the cotter pin is removed, permitting free displacement of the support shoe. Once the support shoe is in position on the bench, the cotter pin is replaced on the guiding sleeve with support against the rod of the shoe, a locking in which the shoe is supported against the bench.

Advantageously, and to the extent in which the base portion of the pulling tower is made up of two beams axially aligned with each other, and articulated around a vertical shaft, the beam located on the side adjacent to the bench comprises a vertical cylindrical socket, while the other beam comprises, a plurality of apertures vertical and truncated cone-shaped, opened toward the top, distributed over a circular sector centered on the shaft for the pivoting of the two beams on each other. The end of the jack body or stem, which is opposite the one articulated on the arm, is fitted with articulation around a horizontal shaft, with a tip comprising a truncated cone-shaped end the shape of which is complementary to that of the afore-mentioned apertures, and a cylindrical part the shape of which corresponds to the internal diameter of the socket.

In practice, to execute the angular adjusting of the two parts of the square base, it is necessary, the jack tip being removed, to cause one of the two parts to pivot relative to the other to bring them to form the desired angle, it being specified that the socket of the element pertaining of the fore part must be facing one of the aperture pertaining to the rear part of the square. There the jack tip is reengaged with its truncated cone-shaped end coming to engagement into one of the apertures of the same shape, and with the cylindrical part thereof coming to engage with the cylindrical part of the socket.

There exists no danger of accidental unlocking during a period of operation since, when the jack is operated in the direction in which the stem of same would come out, the truncated con--shaped tip associated with one of the ends of the jacks has a tendency to engage itself more strongly into the aperture meant for it.

The slope of the truncated cone-shaped end of the tip, as well as the slope of the corresponding apertures are chosen so as to prevent, under normal conditions of handling, the removal of the tip out of the apertures in which it is engaged.

In any case, the invention will be well understood with the help of the following description, given with reference to the attached schematic drawing which represents, as an example which is not limitative, one form of execution of that bench and of the pulling tower assembly associated with it.

DESCRIPTION OF A PREFERRED EMBODIMENT

Figure 1:
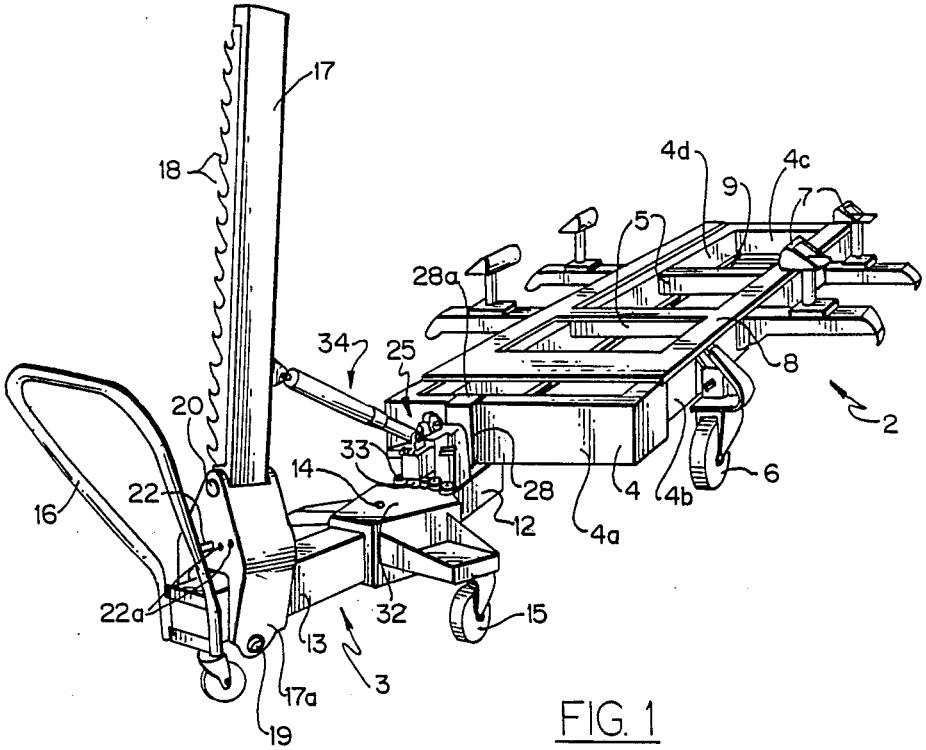
FIG. 1 is a perspective view of the bench and pulling tower assembly of the present invention.

According to the invention, bench 2 comprises a frame 4 made from four tubular elements 4*a*–4*d*, between the two longer- sides 4*b* and 4*d* of which are mounted two transverse crosspieces 5.

In a manner known in the art, the bench is equipt with wheels 6 which permit its displacement on the ground, with clamps 7 for securing the chasis of the vehicle to be repaired to the bench, and with a frame-like device indicated generally by reference 8, which permits the assembing of various control accessories onto the bench.

Figure 2:
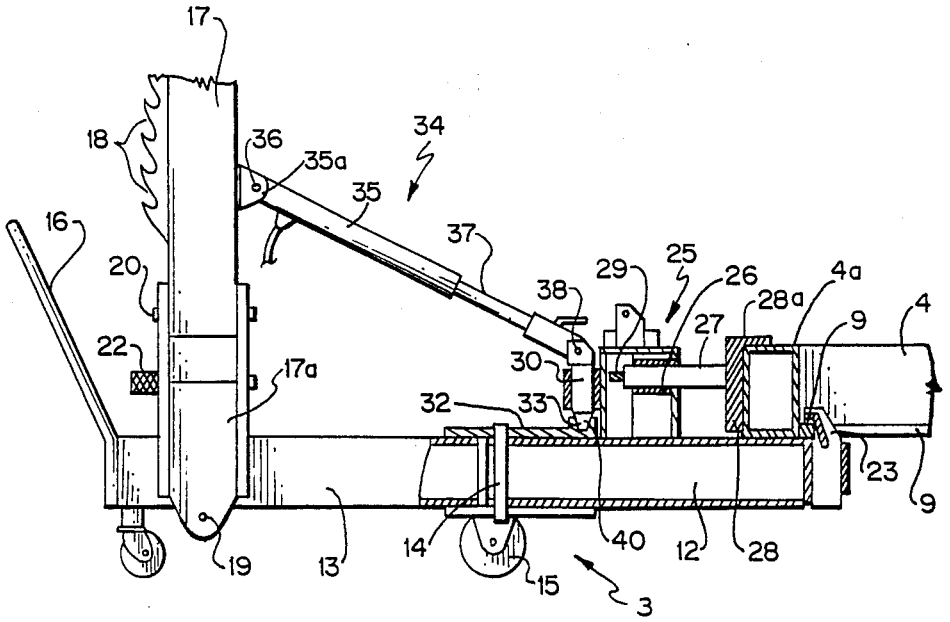
FIG. 2 is a longitudinal section view through a vertical plane along line 2—2 in FIG. 3, of the pulling tower assembly and of the end of the bench to which it is affixed.

As it can be seen in FIG. 2 of the drawing, element 4*a* of the rectangular frame 4 is equipt, on its inner surface and near the lower edge thereof, with a flange 9 in the form of a metallic element square cross-section. The flange 9 serves the double function of reinforcing the rigidity of the tubular frame 4 and making possible securing of the pulling tower assembly to the frame 4.

Figure 3:
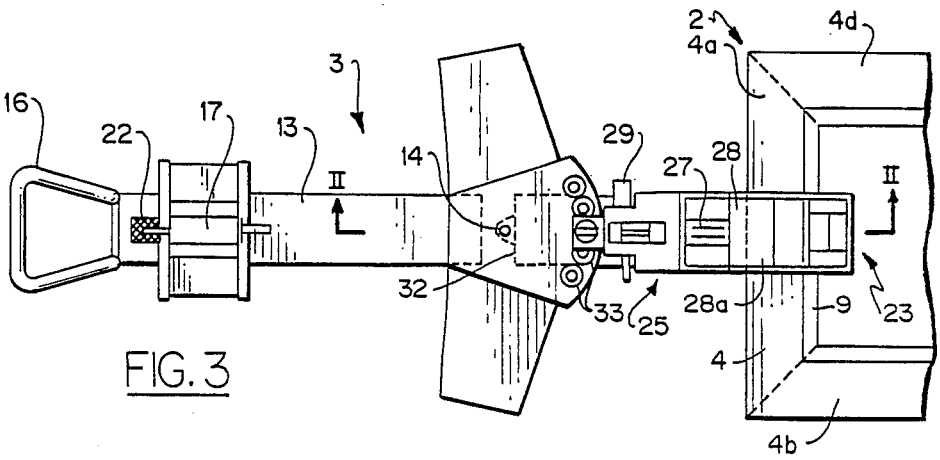
FIG. 3 is a top plan view of the bench and pulling apparatus of the invention.

The pulling tower assembly 3, represented in more detail in FIGS. 2 and 3, comprises a base 10 formed of two beams 12 and 13, placed in axial alignment and articulated on each other around a shaft 14.

In a known manner, the pulling tower assembly 3 is equipt with wheels 15, with a handling handle 16, as well as with an arm 17 which defines a plurality of notches 18 for the hooking of one end of a chain (not shown) the other end of which is hooked to the body of the vehicle (not shown) to be repaired.

The arm 17 is capable of pivoting around a horizontal shaft 19 which extends perpendicular to beam 13 and through a base portion 17*a* of the arm. The lateral slant of arm 17 can be adjusted by pivoting the arm around a shaft 20, which extends axially of the beam 13. When the lateral slant has been set, the arm 17 is locked at the desired slope by means of a pin 22 which is inserted into the proper one of a plurality of apertures 22*a* in base portion 17*a*.

Figure 4:
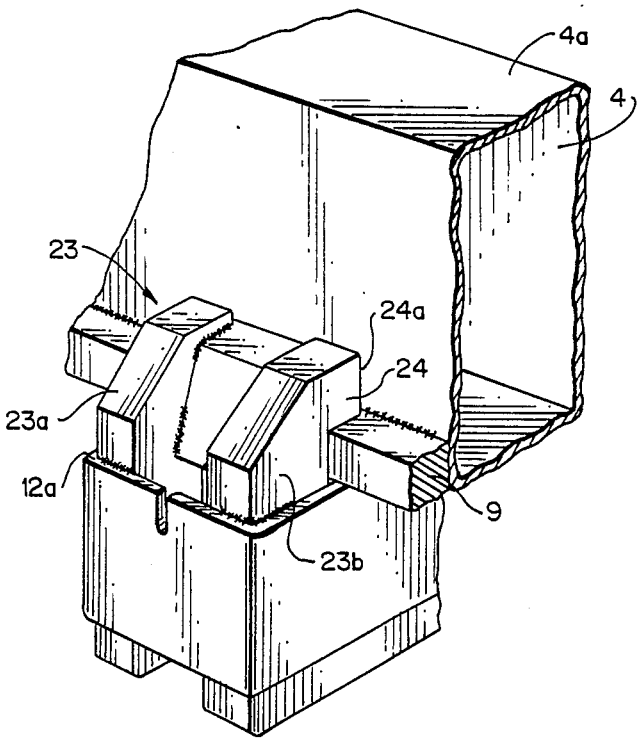
FIG. 4 is an enlarged fragmentary view of the device for securing the pulling tower the bench.

Referring to FIGS. 3 and 4, beam 12 has its forward end detachably secured to the bench by a stirrup 23 comprising two parallel jaws 23*a* and 23*b*, located on the upper edge 12*a* of the forward end of beam 12. The opening of the stirrup 23 is faced toward the rear.

As seen in FIG. 4, the stirrup 23 is received the flange on the inner surface of the frame element 4*a*. The width of the upper arm 24 of the stirrup 23 is less than the width of flange 9. Thus end 24*a* is spaced apart from the surface of flange 9, in order to prevent the end 24*a* of the upper jaw of the stirrup from coming into contact with tubular element 4*a* and from damaging same.

It can also be seen in FIG. 2 that the locating of the stirrup 23 over the forward end of the flange 9 is very easily accomplished, due to the limited height of stirrup 23, and the fact that the horizontal length of flange 9 which is engaged beneath the bench is very short, something which translates itself by a total length of the flange 9 which also is limited.

Referring to FIGS. 2 and 3, on the upper surface of beam 12 intermediate its ends, there is mounted an assembly 25 comprising a longitudinal sleeve 26 which receives in guiding engagement, a rod 27 the forward end of which is equipt with an L-shaped shoe 28 adapted for extension to engage and abut against the external surface of tubular side element 4*a* of the bench on which the flange 9 is fixed. The shoe 28 is equipt with an upper horizontally extending return portion 28*a* which is moved to overlie the upper surface of the tubular element 4*a* of the bench when rod 27 is extended. This shoe 28 engaging the upper surface of element 4*a*, while stirrup 23 "captures" flange 9, at the diametrically opposite corner of the element 4*a*, enhances the rigidity of flange 9 the square of the bench during an ascending displacement of the latter, for example, when it is affixed to lift (not shown).

As seen in FIGS. 2 and 3 of the drawing, shoe 28 may be axially displaced by sliding of rod 27 in sleeve 26, and the shoe may be locked in a position of support against a side element 4*a*, by means of a cotter pin 29, which is engaged in a transverse opening of sleeve 26 and takes its support on the rear end of rod 27 of shoe 28.

Figure 5:
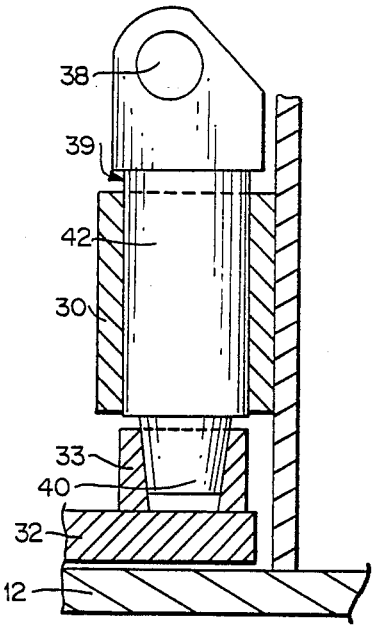
FIG. 5 is a longitudinal section view, in larger scale, of a locking assembly of the bench; and, FIG. 6. illustrates the pulling tower in various work positions relative to the bench.

As shown best in FIGS. 2, 3 and 5, the assembly 25 is equipt with a cylindrical socket 30 on its rear surface. The axis of the socket 30 is vertical. In addition, beam 13 is equipt with a sleeve 32 which diverges horizontally in the direction of beam 12, and meant to partially cover the latter. On the upper surface of sleeve 32, there are provided a plurality of apertures 33 disposed along a circular sector centered on shaft 14 for the articulation of the two beams 12 and 13. Each of the apertures 33 is in the shape of a truncated cone the axis of which is vertical.

In addition, the pulling tower assembly 3 includes a hydraulic jack 34 as is know in the art. The body 35 of the jack is mounted at its butt end 35*a* for articuation around a horizontal shaft 36, on arm 17, while the rod end 37 is mounted for articulation around a horizontal shaft 38, with a tip indicated generally at 39, comprising one end 40 in the shape of a truncated cone, the shape of which is complementary to that of apertures 33, and a cylindrical part 42, the diameter of which corresponds to the internal diameter of socket 30.

As explained above, the locking of the two beams 12 and 13 in the desired anuglar position is achieved by engaging tip 39 of the jack rod on one side into socket 30 associated with beam 12 and, on the other side, into a selected one of truncated cone shaped apertures associated with beam 13.

This arrangement makes possible reduction in the length of the beam as compared to the case in which the devices which mount the rod end of the jack to the base, and the devices which enable articulation of the two parts of the pulling tower 3 on each other, are axially shifted.

Referring to FIGS. 1–3, in use, to detachably secure the pulling tower assembly 3 to the bench 2, with the shoe 28 retracted, the forward end of beam 12 of the pulling tower is positioned under the bench 2 with the stirrup 23 extending beyond the flange 9. Then beam 12 is moved backwards in order for the stirrup 23 to be moved and hook itself over the flange 9 located on the lower inside edge of the frame member 4*a*.

When the stirrup 27 is located over the flange 9, the rod 27 is extended with the forward displacement of the rod causing placement of the shoe 28 into support against and engagement with the external wall of tubular elements 4*a* constituting the bench frame. This locks the pulling tower assembly 3 to the bench 2 in that position.

It can be seen from the above that attachment of the pulling tower assembly 3 to the bench 2 is a very simple operation. Moreover, the pulling tower has a reduced size relative to known pulling towers because its base portion require attachment to only one frame element of the bench.

In addition, this arrangement makes possible, during the use, self-locking of the pulling tower on the bench. If during use of the pulling tower, the posterior end of same tends to tip upward, such displacement causes the stirrup 23, mounted at the fore end of the flange 9, to hook itself onto the flange 9 thus preventing all play between the pulling tower and the frame.

According to a feature of the invention, the return portion 23*a* of the stirrup 23 which hooks the pulling tower on the bench has a width less than that of the flange 9 against which the stirrup is supported. That arrangement proves advantageous because the stirrup 23 simply covers the flange of the bench, and does not engage the main side walls of the bench frame which prevents damaging of the bench.

In practice, to execute the angular adjusting of the two beams 12, 13 of the square base pulling tower, with the jack tip 39 being removed from the sleeve and aperture, to cause one of the two beams to pivot relative to the other to bring them to form the desired angle, it being specified that the socket 30 of the beam 12 must be aligned with one of the apertures 33 of the rear beam 12. Then the jack tip 39 is reengaged with its truncated cone-shaped end 40 located in the selected one of the apertures of and with the cylindrical part 42 thereof passing through the cylindrical socket 30. There exists no danger of accidental unlocking during a period of operation since, when the jack is operated in the direction in which the stem of same would come out, the truncated cone-shaped tip associated with one of the ends of the jacks has a tendency to engage itself more strongly into the aperture meant for it.

The slope of the truncated cone-shaped end of the tip, as well as the slope of the corresponding apertures are chosen so as to prevent, under normal conditions of handling, the removal of the tip out of the apertures in which it is engaged.

Figure 6:
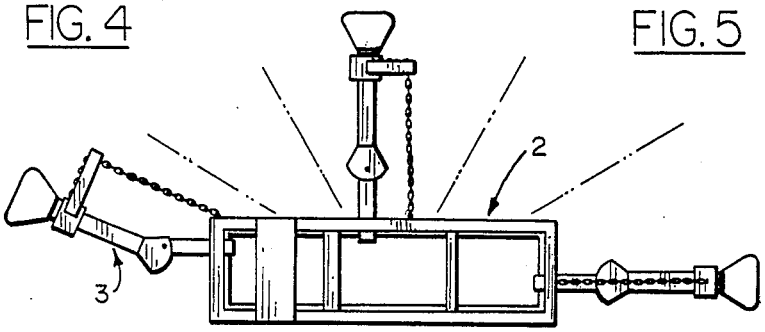

As it may be seen from the above, the invention offers an important improvement on the existing technique, by supplying a device simple in design which makes it possible to obtain a bench characterized by a geat rigidity and which, consequently, is insensitive to the unevennesses of the ground on which it rests, and with which there is associated pulling tower which is very easily handled and the length of wich is greatly reduced. This makes possible use of the apparatus in a shop of liited area, as it may be seen from the several work positoins illustrated in FIG. 6.

I claim:

1. In an apparatus for the repair and checking of vehicle bodies, of the type including a bench having a rectangular frame and traction means having means for attachment to the bench, the improvement comprising:

a plurality of tubular elongated members defining said frame, including a first pair of members extending in a parallel spaced relation defining first and second sides of said frame and a second pair of members extending between said first and second members defining third and fourth sides of said frame, at least one of said members having a projection near a lower surface thereof, said traction means including a base portion with connecting means mounted on said base portion near one end thereof and adapted for engagement with said projection on said one tubular member and locking means carried by said base near said one end and constructed and arranged for movement between locking and unlocking positions, said locking means when moved to said locking position engaging an outer surface of said one member near the top thereof, urging said one member into engagement with said connecting means, and means for maintaining said locking means at said locking position.

2. Apparatus according to claim 1, wherein said projection means extends outwardly rearwardly of said one member near a lower surface thereof and said connecting means extending beneath said one member and including means defining a channel for receiving said projection means.

3. Apparatus according to claim 2, wherein the depth of said channel is less than the length of said projection means whereby said connection means is spaced apart from the inner surface of said member and overlies only a portion of said projection means projecting therefrom.

4. Apparatus according to claim 2, wherein said locking means includes a tubular member mounted for sliding movement, horizontally, within a sleeve, an a support shoe member carried by the free end of said tubular tube for movement into engagement with an external surface of said one member when said tubular member is moved from an unlocking position to a locking position, and means for preventing axial movement of said tubular member relative to said sleeve thereby locking said tubular member and said support shoe member in position.

5. Apparatus according to claim 2, wherein said connecting means engages said projection when locked in place by said locking means thereby preventing downward movement of said connection means relative to the bench whereby tilting of said traction means relative to said bench is prevented.

6. Apparatus according to claim 2, wherein said projection means comprises a flange generally rectangular in shape extending around the inner periphery of said frame near the lower edges of said frame defining members, said connection means comprising a stirrup having a channel formed therein for receiving said flange of any one of said elements, the depth of the channel defined by said stirrup being less than the width of said flange whereby said stirrup is maintained spaced apart from the surface of said element from which said flange projects.

7. Apparatus according to claim 1, wherein said traction means comprises first and second axially aligned beams, pivot means connecting said beams near adjacent ends thereof, an arm extending generally vertically upward from one of said beams, first adjustable means permitting lateral adjustment of said arm relative to said one beam, in a direction transverse to the axis thereof, second adjustable means permitting pivotal movement of said arm about an axis transverse to said one beam, and third adjustable means for coupling said first and second beams together, permitting relative articulating movement of the beams.

8. Apparatus according to claim 7, wherein said third adjustable means comprises a member defining a plurality of truncated cone-shaped apertures provided on one of said beams and at least one cone-shaped projection, complementary in shape to said apertures depending from said other beam and adapted for receipt in any one of said apertures.

9. Apparatus according to claim 8, wherein said traction means further comprises hydraulic means interposed between said arm and including a rod member with a tip portion complementary in shape to said apertures whereby placement of said tip portion of said rod member in a selected one of said apertures defines a given orientation of said hydraulic means relative to said interconnected first and second beams.

10. In an apparatus for the repair and the checking of vehicle bodies, of the type including a bench having a rectangular frame and a traction means having means for attachment t the bench, the improvement comprising:

a plurality of tubular members defining said frame, at least one of said members having a projection near the lower surface thereof, said traction means including a base portion adapted for engagement with the under side of said frame and having a stirrup on one side at its forward end thereof at the upper edge thereof, said stirrup being open ended toward the rear and adapted to be brought into engagement with said projection of said bench frame members, said base further including locking means including a shoe member carried thereon near said forward end and directed forward and axially movable into engagement with said one member on the forward surface thereof and cooperating with said stirrup to lock said traction means to the bench.

11. Apparatus according to claim 10, wherein said stirrup includes means for hooking the tension means to the bench and defining a slot of a depth that is less than the horizontal extent of said projection.

12. In an apparatus for the repair and the checking of vehicle bodies, of the type including a bench having a rectangular frame and a traction means having means for attachment to the bench, the improvement comprising:

a plurality of tubular members defining said frame, at least one of said members having a projection near the lower surface thereof, said traction means including a base portion adapted for engagement with the under side of said frame and having a stirrup on one side at its forward end thereof at the upper edge thereof, said stirrup being open ended toward the rear and adapted to be brought into engagement with said projection of said bench frame members, said base further including locking means including a support shoe member carried thereon near said forward end and directed forward and axially movable into engagement with an external wall of said one member on the forward surface thereof and cooperating with said stirrup to lock said traction means to the bench, said means for locking said support shoe member against the external wall of said one member further including a guide sleeve and a rod member mounted for slidable movement within said guide sleeve and carrying said support shoe member at one end thereof, and means for locking said tube relative to said guide sleeve thereby locking said support shoe member against the external wall of said one member.

13. In an apparatus for the repair and the checking of vehicle bodies, of the type including a bench having a rectangular frame and a traction means having means for attachment to the bench, the improvement comprising:

a plurality of tubular members defining said frame, at least one of said members having a projection near the lower surface thereof, said traction means including a base portion adapted for engagement with the under side of said frame and having stirrup on one side at its forward end thereof at the upper edge thereof, said stirrup being open ended toward the rear and adapted to be brought into engagement with said projection of said bench frame members, said base further including locking means including a shoe member carried thereon near said forward end and directed forward and axially movable into engagement with said one member on the forward surface thereof and cooperating with said stirrup to lock said traction means to the bench, said traction means further comprising first and second beams aligned axially one with another and articulated around a vertical shaft, said first beam located adjacent to the bench and carrying said locking stirrup thereon on an upper surface thereof and defining on an upper surface thereof a vertical cylindrical socket, said second beam including a plurality of vertical truncated cone-shaped apertures located below said socket and opened toward the top, said apertures distributed over a sector centered on a shaft for pivoting of the two beams relative to one another, an arm member pivotally mounted to said second beam, an hydraulic means interposed between said arm and said first beam and including a rod member having a tip portion with a truncated cone-shaped end the shape of which is complementary to that of said apertures, and a cylindrical part the shape of which corresponds to the internal diameter of said socket.

14. In an apparatus for the repair and the checking of vehicle bodies, of the type including a bench having a rectangular frame and a traction means having means for attachment to the bench, the improvement comprising:

a plurality of tubular members defining said frame, at least one of said members having a projection near the lower surface thereof, said traction means including a base portion adapted for engagement with the under side of said frame and having a stirrup on one side at its forward end thereof at the upper edge thereof, said stirrup being open ended toward the rear and adapted to be brought into engagement with said projection of said bench frame members, said base further including locking means including a shoe member carried thereon near said forward end and directed forward and axially movable into engagement with one of said tubular members on the forward surface thereof and cooperating with said stirrup to lock said traction means to the bench, said shoe member being constructed and arranged for engagement with said one tubular member and having an horizontally extending portion and a vertically extending portion adapted to engage horizontal and vertical surfaces respectively of said one member when said shoe member is locked in its locking position.

* * * * *

UNITED STATES PATENT AND TRADEMARK OFFICE

CERTIFICATE OF CORRECTION

PATENT NO. : 4,791,802

DATED : December 20, 1988

INVENTOR(S) : Germain Celette

It is certified that error appears in the above-identified patent and that said Letters Patent is hereby corrected as shown below:

On the title page Insert

--(73) Assignee: Celette S.A. --.

Claim 10, line 25, "t" should read --to--.

Signed and Sealed this

Twenty-fifth Day of July, 1989

*Attest:*

DONALD J. QUIGG

*Attesting Officer*

*Commissioner of Patents and Trademarks*